United States Patent [19]

Thettu

[11] 3,948,214

[45] Apr. 6, 1976

[54] INSTANT START FUSING APPARATUS

[75] Inventor: Raghulinga R. Thettu, Webster, N.Y.

[73] Assignee: Xerox Corporation, Stamford, Conn.

[22] Filed: Feb. 4, 1975

[21] Appl. No.: 547,076

[52] U.S. Cl. ..... 118/60; 118/101; 118/202; 432/60; 432/228

[51] Int. Cl.[2] ..... G03G 15/20

[58] Field of Search ..... 118/60, 101, 202; 432/60, 432/228; 29/132

[56] References Cited

UNITED STATES PATENTS

| | | | |
|---|---|---|---|
| 2,997,406 | 8/1961 | Freeman et al. | 118/60 |
| 3,291,466 | 12/1966 | Aser et al. | 432/228 |
| 3,649,992 | 3/1972 | Thetty | 118/60 |
| 3,669,706 | 6/1972 | Sanders et al. | 118/202 |
| 3,686,731 | 8/1972 | Koori et al. | 29/132 |
| 3,745,972 | 7/1973 | Thetty | 118/60 |
| 3,809,854 | 5/1974 | Sanders | 432/60 |
| 3,883,291 | 5/1975 | Cloutier et al. | 118/60 |

*Primary Examiner*—Mervin Stein
*Assistant Examiner*—Douglas Salser

[57] ABSTRACT

Apparatus of the type which fuses toner images onto support material by heat and pressure including an instantly heated fuser roll and a pressure back-up roll having an elastomeric surface. The fuser roll has a cylindrical member made of quartz or other material which transmits radiant energy from a source located on the interior of the cylindrical member. The cylindrical member has a first layer made of elastomeric material which transmits radiant energy. The first layer is covered with a second layer of material which absorbs radiant energy. A third layer of material covers the second layer of heat absorbing material to effect a good toner release characteristic on the fuser roll surface. The third or image contacting layer may be made of an elastomeric material where dry fusing is preferred or alternatively a rigid material where a silicone oil is applied to the image contact layer to prevent toner offset onto the fuser roll surface. The fuser roll layers are relatively thin and have an instant start capability to fuse toner images onto support material, such as paper.

6 Claims, 2 Drawing Figures

INSTANT START FUSING APPARATUS

This invention relates to an improved pressure heated fusing apparatus used in an electrostatic reproduction system to produce high quality copies free of toner offset.

It has been recognized that one of the preferred ways for fusing a powder image to a support material is to bring the powder image into direct contact with a hot surface, such as a heated roller. The roller surface may be dry, i.e. no application of a liquid release agent to the surface of that roller as described for example, in U.S. Pat. Nos. 3,498,596, 3,539,161 and 3,666,247. Alternatively, the fuser roll surface may be wetted with a release agent, such as, silicone oil as described in U.S. Pat. Nos. 3,268,351 and 3,256,002.

A problem associated with the pressure heated fusing apparatus is the relatively long time for warm up prior to reaching operating fusing temperature. It is known to employ radiation absorbing materials for the fuser roll construction to effect faster warm up time as described, for example, in U.S. Pat. No. 3,669,706. The instant invention enables instant start fusing capability without any loss of fusing quality such as toner offset.

It is therefore the principle object of the present invention to improve pressure heated fusing apparatus.

It is a further object of the present invention to enable rapid starting pressure heated fusing apparatus.

It is a further object of the present invention to prevent toner offset from the surface of a heated fuser roll onto copy sheets.

It is a further object of the present invention to improve copy quality of copy sheets fused by rapid starting pressure heated fuser systems.

Figure 1:
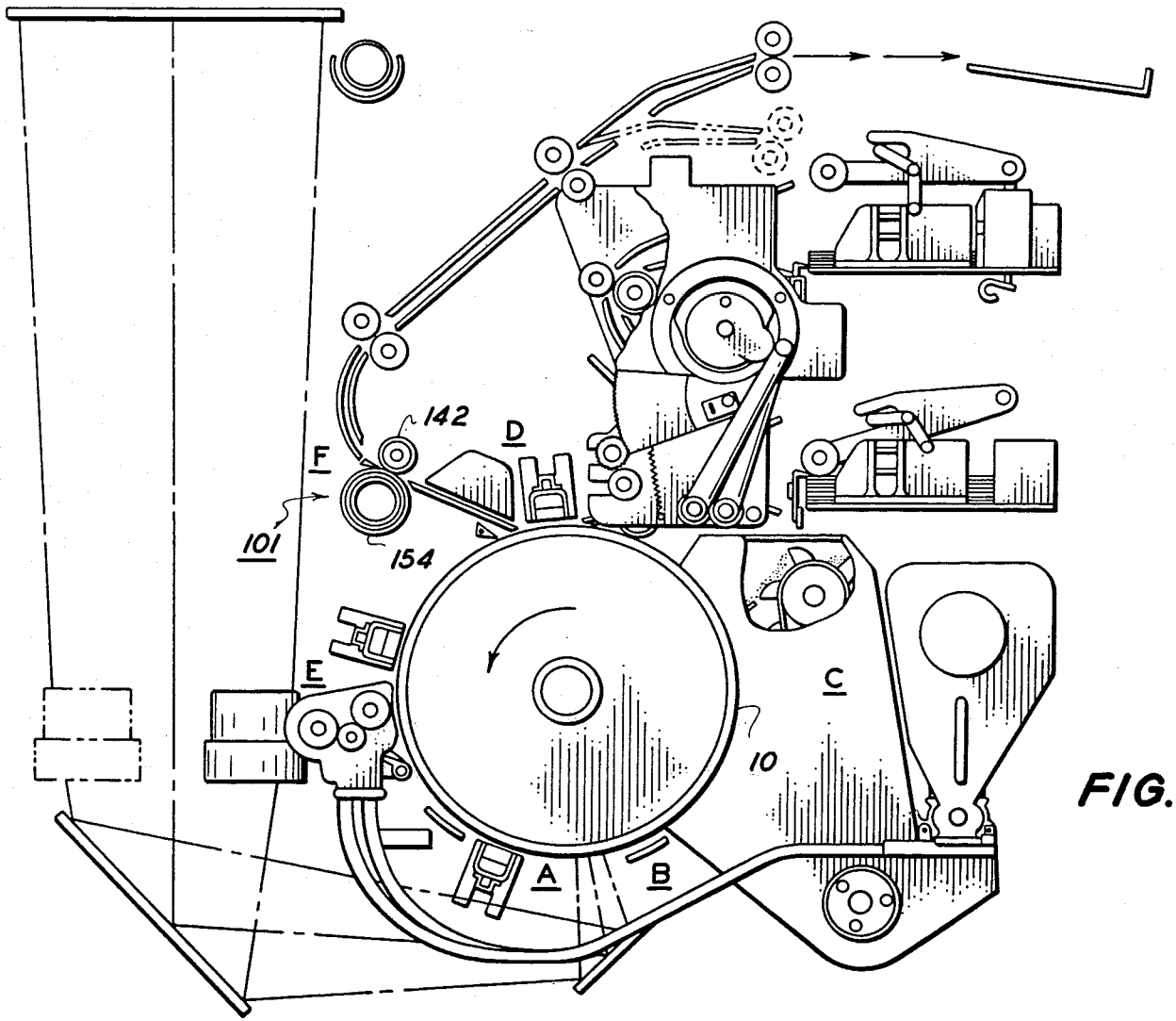
Figure 2:
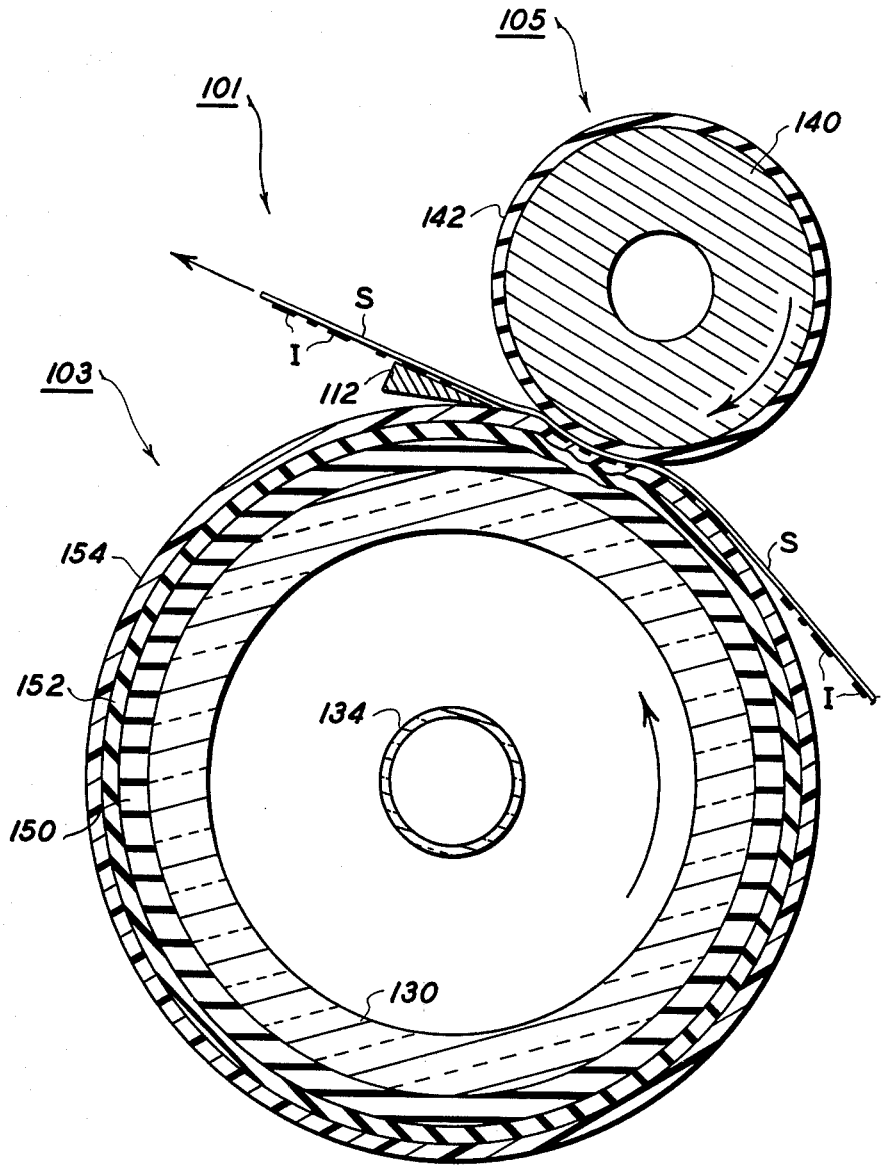

These as well as other objects of the invention and further features thereof will be better understood upon reference to the following detailed description of the invention to be read in connection with the drawings wherein:

FIG. 1 illustrates schematically a xerographic reproducing apparatus incorporating pressure heated fuser apparatus constructed in accordance with the present invention and, FIG. 2 is an enlarged portion of the nip pressure heated fusing apparatus illustrating details thereof of the invention.

Referring now to the drawings, there is shown in FIG. 1 an automatic xerographic reproducing machine incorporating an improved pressure heated fusing apparatus according to the present invention. The automatic xerographic reproducing machine includes a xerographic plate or surface 10 formed in the shape of a drum. The plate has a photoconductive layer or light receiving surface on a conductive backing, journaled in a frame to rotate in the direction indicated by the arrow. The rotation will cause the plate surface to sequentially pass a series of xerographic processing stations. For the purpose of the present disclosure the several xerographic processing stations in the path of movement may be described functionally as follows:

A charging station A, at which a uniform electrostatic charge is deposited on the photoconductive plate;

An exposure station B, at which light or a radiation pattern of copies to be reproduced is projected onto the plate surface to dissipate the charge in the exposed areas thereof to thereby form a latent electrostatic image of the copy to be reproduced;

A developing station C, at which xerographic developing material, including toner particles having an electrostatic charge opposite to that of the latent electrostation image, is cascaded over the latent electrostatic image to form a toner powder image in configuration of the copy being reproduced;

A transfer station D at which the toner powder image is electrostatically transferred from the plate surface to a support material such as paper;

A drum cleaning and discharge station E at which the plate surface is brushed to remove residual toner particles remaining thereon after image transfer and at which the plate is exposed to a relatively bright light source to effect substantially complete discharge of any residual electrostatic charge remaining thereon; and A fusing station F at which is positioned pressure heated fusing apparatus 101 for fusing powder images onto the support material as will be described more fully hereinafter.

The preceding description of the xerographic process stations is sufficient for an understanding of the instant invention. Further details may be had by reference to U.S. Pat. No. 3,578,859 filed July 3, 1969 and commonly assigned herewith.

Referring now to FIG. 2 the fusing apparatus 101 comprises a fuser roll 103 and pressure roll 105 through which the copy sheets to be fused are advanced. The copy sheet is stripped from the fuser roll by stripper fingers 112. The fuser roll comprises a rotating cylindrical member 130. The fuser roll may be internally heated by a radiant energy source 134 such as an infrared lamp. The pressure roll comprises a rotating member 140 which is covered with an elastomeric layer 142 made of silicone rubber.

In accordance with the invention cylindrical member 130 is made of material transmitting radiant energy. Any suitable material can be used, such as quartz. A layer 150 is made of an elastic material which transmits infrared radiation from lamp 134 covers the surface of cylindrical member 13. Any suitable material can be used. Typical materials are dimethyl RTV silicone rubber compounds, manufactured under the tradename GE602/615 by General Electric Co. and potting encapsulating silicone resins manufactured under the tradename Sylgard 184 by Dow Corning Corporation. A layer 152 made of energy absorbing material covers layer 150. Layer 152 is an adhesive sealant which can be made of any suitable material such as black silicone rubber as for example, Silastic RTV DC732 or DC735 which are trademarks of Dow Corning Corporation. Another layer 154 which is made of material which resists toner offset covers layer 152, Layer 154 contacts the support sheet S bearing toner images I and prevents image offset to effect high quality fusing of copy sheets. For a dry fusing system layer 154 is made of an elastomeric material such as silicone rubber. For a wetted fusing system layer 154 is made of a fluorosilicone rubber. Alternatively, layer 154 can be a rigid material which is any suitable fluorocarbon plastic. Suitable fluorocarbon plastics are fluoro ethylene propylene and polytetrafluoro ethylene or Teflon, a trademark of duPont Corporation. When layer 154 is made of a fluorocarbon plastic it is also wetted with silicone oil to prevent toner offset.

The thickness of all the layers 150, 152, and 154 is quite thin and ranges from about 8 to about 15 mils. It has been found that an instant warm up of the fusing apparatus is achieved due to the heat absorbing characteristics of the relatively thin layer. Moreover because of the toner offset characteristics of the image contacting layer, high quality copies are provided. It will be appreciated that this type of operation is highly desirable in the electrostatic copying field.

While there have been shown and described and pointed out the fundamental novel features of the invention as applied to a preferred embodiment it will be understood that various omissions and substitutions and changes may be made in the form and details of the device illustrated and in its operation may be made by those skilled in the art without departing from the spirit of the invention.

What is claimed is:

1. In an electrostatic copying machine having a heated pressure fusing apparatus of the type including a heated fuser roll and a pressure back-up roll defining a nip through which support material bearing toner images is passed for fusing the toner images onto the support material, an instantly heated fuser roll comprising:

a cylindrical member made of material which transmits radiant energy, a source of radiant energy positioned interior to said cylindrical member, first, second and third layers of relatively thin material covering said cylindrical member, said first layer being of an elastomeric material transmitting radiant energy covering the surface of said cylindrical member, said second layer being an elastomeric material which absorbs radiant energy covering said first layer, and said third layer which contacts the toner images to be fused being a material having toner release characteristics covering said second layer, wherein said first, second and third layers have a combined thickness ranging from about 8 to about 15 mils.

2. Apparatus according to claim 1 wherein said third layer is made of an elastomeric material which is silicone rubber.

3. Apparatus according to claim 1 wherein said third layer is made of fluorosilicone rubber.

4. Apparatus according to claim 1 wherein said third layer is made of a fluorocarbon plastic material.

5. Apparatus according to claim 3 wherein silicone oil serves as a wetting agent.

6. Apparatus according to claim 4 wherein silicone oil serves as a wetting agent.

* * * * *